United States Patent [19]

Ebenhoech et al.

[11] Patent Number: 4,652,305

[45] Date of Patent: Mar. 24, 1987

[54] PREPARATION OF IRON POWDER

[75] Inventors: Franz L. Ebenhoech, Ludwigshafen; Reinhold Schlegel, Hassloch, both of Fed. Rep. of Germany

[73] Assignee: BASF Aktiengesellschaft, Fed. Rep. of Germany

[21] Appl. No.: 760,043

[22] Filed: Jul. 29, 1985

[30] Foreign Application Priority Data

Jul. 31, 1984 [DE] Fed. Rep. of Germany ..... 3428121

[51] Int. Cl.[4] ..... C22C 1/04

[52] U.S. Cl. ..... 75/0.5 BA

[58] Field of Search ..... 75/0.5 BA

[56] References Cited

U.S. PATENT DOCUMENTS

| | | | |
|---|---|---|---|
| 1,759,659 | 5/1930 | Mittasch et al. | 75/0.5 |
| 2,597,701 | 5/1952 | Beller | 75/0.5 |
| 2,612,440 | 9/1952 | Altmann | 75/0.5 |
| 2,674,528 | 4/1954 | Beller et al. | 75/0.5 |
| 2,846,299 | 8/1958 | Schlecht et al. | 75/0.5 |
| 2,851,347 | 9/1958 | Schlecht et al. | 75/0.5 |
| 3,376,129 | 4/1968 | Syrkin et al. | 75/0.5 |

FOREIGN PATENT DOCUMENTS

| | | | |
|---|---|---|---|
| 500692 | 9/1930 | Fed. Rep. of Germany | 75/0.5 |
| 824198 | 12/1951 | Fed. Rep. of Germany | 75/0.5 |
| 679439 | 12/1950 | United Kingdom | 75/0.5 |
| 825740 | 12/1959 | United Kingdom | 75/0.5 |

*Primary Examiner*—Peter D. Rosenberg

*Attorney, Agent, or Firm*—Keil & Weinkauf

[57] ABSTRACT

Iron powder is prepared by thermal decomposition of iron pentacarbonyl in a cavity decomposer, with an average amount of from 4 to 8 kg per $m^2$ per hour of iron carbonyl striking the heating surface, by a process in which the velocity of the inflowing stream is brought to about 0.2–4 kg per $m^2$ per second of carbonyl vapor or vapor/inert gas mixture by changing the inlet cross-section.

7 Claims, No Drawings

PREPARATION OF IRON POWDER

The preparation of finely divided iron powder by thermal decomposition of iron pentacarbonyl in a cavity heated from the wall has long been known. Finely divided iron powder is formed without iron being deposited on the hot reactor wall.

The process based on the cavity decomposer principle has been the subject of much improvement and refinement, in particular with the aim of producing special types of powders which differ in, for example, particle size.

It is known that a very finely divided iron powder can be prepared by diluting the iron carbonyl vapor or by increasing the carbonyl throughput, and a particularly coarse-particled iron powder can be produced by means of a very low carbonyl throughput.

It has also been disclosed that special iron powders, especially finely divided ones, are obtained by carrying out the thermal decomposition of iron carbonyl in the presence of oil vapor (U.S. Pat. No. 2,612,440), in the presence of sound waves (U.S. Pat No. 2,674,528) or under very special conditions under reduced pressure (U.S. Pat. No. 2,597,701).

Experience has shown that undesirable decomposition of iron carbonyl and hence deposition of hard iron crusts in the evaporator, in the pipeline from the evaporator to the decomposer and at the inlet nozzle limits the life of a decomposer. Cooling the decomposer cover has been proposed as a measure for counteracting this.

It is an object of the present invention to prepare iron powders having various particle sizes and of constant quality over a substantially longer operating time, the process being carried out in a conventional cavity decomposer.

We have found that this object is achieved and that, in the preparation of iron powder by thermal decomposition of iron pentacarbonyl in a cavity decomposer with an average amount of from 4 to 8 kg per $m^2$ per hour of iron carbonyl striking the heating surface, the particle size and particle distribution can be varied within wide limits if the velocity of the inflowing stream is set at about 0.2–4 kg per $m^2$ per second of carbonyl vapor or vapor/inert gas mixture by changing the cross-section of the inlet.

Advantageously, the velocity of the inflowing stream is set at above 1, preferably above 2, kg per $m^2$ per sec. in order to produce particle sizes of less than about 2 $\mu$m, and at less than 1, preferably less than 0.6, kg per $m^2$ per sec. in order to produce particle sizes greater than 6 $\mu$m.

The desired change in the velocity of the inflowing iron carbonyl vapor can be effected in a simple manner by replacing the vapor inlet nozzle on the decomposer cover with one which has a different nominal diameter, or by inserting easily exchangeable metal collars of appropriate diameter into a wide nozzle. Any ammonia which has to be added can be introduced into the annular space around the collar. In order to maintain the desired product quality over a long period, for example 3000 operating hours or longer, it is advantageous to keep the cross-section free of metallic coatings. This can be achieved by reducing the temperature of the boiling carbonyl and of the vapor until they reach the entrance of the decomposer.

A simple and effective method of reducing the vaporization temperature of the metal carbonyl comprises passing an inert gas, preferably carbon monoxide, into the boiling liquid. An adequate amount for this purpose is an amount which is much smaller than that required in the case of a dilution gas or a heat transfer medium for the production of very fine particles. For example, it is sufficient to add one part by volume of inert gas per 2 parts by volume of carbonyl vapor and thus to reduce the boiling point of the iron carbonyl in the evaporator from 110° C. to 90° C. If the iron carbonyl is free of carbon dioxide, the boiling point can also be reduced by using the ammonia which is usually present in the decomposer.

By passing inert gas into the boiling iron carbonyl, the particular decomposer inlet cross-section used can be kept free from coatings and therefore constant. In this way, it is also possible substantially to prolong the operating time of the evaporator and of the decomposer and to save maintenance costs.

Of the total range of throughput through the decomposer which is possible for the decomposition of iron carbonyl, the procedure below the range according to the invention results in deposition of iron on the heating surface, while the range above the range according to the invention, where the flow rate over the heating surface is very high, leads to a carbonyl-moist powder which in some cases has a high carbon content. Reliable operation is achieved using a throughput of from 4 to 8 kg of iron carbonyl per $m^2$ of heating surface per hour.

The examples are carried out using a cavity decomposer of conventional construction which has an internal diameter of 1 m and a length of 5 m and is heated from outside with hot air. The flat cover possesses a central nozzle which has a diameter of 300 mm and a height of 300 mm and in the upper flange of which flanged metal collars can be clamped in order to alter the inlet cross-section. The carbonyl evaporator has a steam coil which possesses a heating surface of 2 $m^2$. The velocity of the inflowing stream is stated in kg per $m^2$ per second, so the action of the carbon monoxide corresponds to its mass and not its volume.

EXAMPLE 1

The inlet cross-section (diameter 300 mm) is not reduced by means of an insert. 77 kg/h of iron carbonyl are vaporized in the evaporator. This corresponds to an inlet velocity of 0.3 kg per $m^2$ per second and a flow of 4.9 kg per $m^2$ per hour over the heating surface. The internal temperature is from 260° to 280° C. The iron powder separated off has a mean particle size of from 7 to 8 $\mu$m and carbon and nitrogen contents of 0.7% each. The powder is free of spongey or hard constituents. After an operating time of about 1300 hours, the powder quality changes and the particle size decreases to 5–6 $\mu$m. After an operating time of 2150 hours, the decomposer is shut down for cleaning. The cross-section of the decomposer entrance is found to be constricted by uneven coatings. The 70 kg, hard iron crust on the evaporator pipe is knocked off.

If the same conditions are employed and 4.5 $m^3$ of CO, corresponding to about 50% of the volume of the carbonyl vapor, are passed under the surface of the boiling carbonyl, the inlet velocity increases to 0.32 kg per $m^2$ per sec. and the mean particle size of the iron powder decreases only slightly to 6.5 or 6.7 $\mu$m. This particle size remains virtually constant over the entire life of the decomposer and evaporator, ie. 3144 hours. The evaporator temperature is below 95° C. until virtually the end of the life, and the coating on the evaporator coil weighs only about 50 kg.

The example demonstrates the effect of unintentionally changing the cross-section and of reducing the boiling point.

EXAMPLE 2

The decomposer entrance is reduced to 200 mm by means of a metal collar clamped in the 300 mm nozzle. 2.5 $m^3$ of ammonia are passed into the annular space between the nozzle and the collar, and 77 kg/h of iron carbonyl and 4.5 $m^3$ of CO are again passed into the evaporator. This corresponds to an inlet velocity of 0.73 kg per $m^2$ per sec. An iron powder having a mean particle size of 5.5 μm and carbon and nitrogen contents of 0.7% each is obtained in the decomposer at from 270° to 290° C. When the amount of carbonyl is increased to 100 kg/h, corresponding to 0.93 kg per $m^2$ per sec., the mean particle size decreases to 3.8 μm. Free iron carbonyl is not detectable in the powder.

EXAMPLE 3

The decomposer entrance is reduced by means of a metal collar having a diameter of 100 mm. At a throughput of 100 kg/h of iron carbonyl and 6.0 $m^3$ of CO through the evaporator and 2.5 $m^3$ of ammonia through the annular space around the metal collar, and at from 270° to 290° C., an iron powder having a mean particle size of from 1.6 to 1.9 μm is obtained. In this experiment, the inlet velocity is 3.8 kg per $m^2$ per sec. and the flow over the heating surface is 6.4 kg of iron carbonyl per $m^2$ per hour.

Examples 1, 2 and 3 illustrate the advantageous mode of operation in the range claimed.

The decomposer entrance is then reduced to a diameter of 200 mm by means of a metal collar clamped in the flange. The throughput of 50 kg/h of iron carbonyl corresponds to an inlet velocity of 3.44 kg per $m^2$ per sec. and a flow over the heating surface of 3.2 kg per $m^2$ per h. 2.5 $m^3$ of ammonia are passed into the decomposer, and the temperature is kept at from 250° to 260° C. This procedure gives an iron powder which has a mean particle size of from 7 to 8 μm and contains from 10 to 20% of coarse, hard constituents and a particle size greater than 90 μm. This procedure illustrates the disadvantages of too small a flow over the heating surface.

We claim:

1. A process for the preparation of iron powder by thermal decomposition of iron pentacarbonyl in a cavity decomposer with an average amount of from 4 to 8 kg per $m^2$ per hour of iron pentacarbonyl striking the heating surface, wherein the velocity of the inflowing stream is adjusted to about 0.2–4 kg per $m^2$ per second of carbonyl vapor or vapor/inert gas mixture by changing the inlet cross-section.

2. The process of claim 1, wherein an inert gas, is passed under the surface of the vaporizing iron carbonyl in an amount such that its volume corresponds to about 10–300% of the volume of the carbonyl vapor.

3. The process of claim 1, wherein, in order to adjust the particle size to below about 2 μm, the velocity of the inflowing stream is brought to above 1 kg per $m^2$ per sec.

4. The process of claim 1, wherein, in order to adjust the particle size to above 6 μm, the flow velocity is brought to less than 1 kg per $m^2$ per sec.

5. The process of claim 2, wherein the amount of inert gas passed under the surface of the vaporizing iron carbonyl is from 40 to 100% of the volume of the carbonyl vapor.

6. The process of claim 3, wherein the velocity of the inflowing stream is brought to above 2 kg per $m^2$ per sec.

7. The process of claim 4, wherein the flow velocity is brought to less than 0.6 kg per $m^2$ per sec.

* * * * *